US010858850B2

(12) United States Patent
Wheatley et al.

(10) Patent No.: US 10,858,850 B2
(45) Date of Patent: Dec. 8, 2020

(54) WALL REINFORCEMENT SYSTEM AND METHOD

(75) Inventors: Donald E. Wheatley, Ann Arbor, MI (US); Todd Jackson, Belleville, MI (US)

(73) Assignee: FORTRESS STABILIZATION SYSTEMS, Holland, MI (US)

( * ) Notice: Subject to any disclaimer, the term of this patent is extended or adjusted under 35 U.S.C. 154(b) by 0 days.

(21) Appl. No.: 12/212,151

(22) Filed: Sep. 17, 2008

(65) Prior Publication Data

US 2009/0071085 A1 Mar. 19, 2009

Related U.S. Application Data

(60) Provisional application No. 60/973,299, filed on Sep. 18, 2007.

(51) Int. Cl.
*E04G 23/02* (2006.01)

(52) U.S. Cl.
CPC ..... *E04G 23/0218* (2013.01); *E04G 23/0229* (2013.01); *E04G 2023/0251* (2013.01); *E04G 2023/0262* (2013.01)

(58) Field of Classification Search
USPC ..... 52/223.1, 231, 222, 291, 293.1, 293.2, 52/293.3, 309.1, 506.05, 736.3, 738.1, 52/746.1, 514, 514.5, 714.12, 506.01; 29/402.01, 402.09, 402.12, 402.16, 29/402.18; 156/71, 91, 92; 264/36; 428/63, 408, 902
See application file for complete search history.

(56) References Cited

U.S. PATENT DOCUMENTS

| | | | | |
|---|---|---|---|---|
| 2,898,258 | A | | 8/1959 | Meier et al. |
| 3,239,403 | A | | 3/1966 | Williams |
| 4,551,994 | A | | 11/1985 | Vailati et al. |
| 4,631,932 | A | | 12/1986 | Sommers |
| 4,786,341 | A | | 11/1988 | Kobatake et al. |
| 4,786,549 | A | | 11/1988 | Richards |
| 4,916,874 | A | | 4/1990 | McCoy et al. |
| 5,018,331 | A | * | 5/1991 | Forzano ..... 52/514 |
| 5,635,263 | A | | 6/1997 | Saito |
| 5,640,825 | A | * | 6/1997 | Ehsani et al. ..... 52/746.1 |
| 5,649,398 | A | | 7/1997 | Isley, Jr. et al. |
| 5,820,958 | A | * | 10/1998 | Swallow ..... 428/42.2 |
| 5,845,450 | A | | 12/1998 | Larsen |
| 5,882,749 | A | | 3/1999 | Jones et al. |

(Continued)

FOREIGN PATENT DOCUMENTS

JP 2000265141 9/2000

OTHER PUBLICATIONS

ACI Structural Journal, Technical Paper, Title No. 91-S17, Mar.-Apr. 1994, "Strengthening of Initially Loaded Reinforced Concrete Beams Using FRP Plates," by Alfarabi Shari, G.J. Al-Sulaimani, I.A. Basunbuil, M.H. Baluch, and B.N. Ghaleb.

(Continued)

*Primary Examiner* — Theodore V Adamos
(74) *Attorney, Agent, or Firm* — Harness, Dickey & Pierce, P.L.C.

(57) ABSTRACT

A reinforcement system for a wall includes a bracket secured to a support disposed above the wall with a plurality of fasteners. A strap is engaged with the bracket and is adhered to the wall for reinforcing the wall.

18 Claims, 9 Drawing Sheets

(56) References Cited

U.S. PATENT DOCUMENTS

| | | | | |
|---|---|---|---|---|
| 5,894,003 | A | 4/1999 | Lockwood | |
| 6,068,042 | A * | 5/2000 | Blond | 160/330 |
| 6,145,260 | A | 11/2000 | Morton | |
| 6,263,629 | B1 | 7/2001 | Brown, Jr. | |
| 6,418,684 | B1 * | 7/2002 | Morton | 52/293.2 |
| 6,692,595 | B2 | 2/2004 | Wheatley et al. | |
| 6,696,125 | B2 | 2/2004 | Zanchetta et al. | |
| 6,725,613 | B2 * | 4/2004 | Oliver et al. | 52/169.9 |
| 6,746,741 | B2 | 6/2004 | Wheatley | |
| 6,846,537 | B2 | 1/2005 | Wheatley et al. | |
| 6,851,232 | B1 * | 2/2005 | Schwegler | 52/223.8 |
| 6,928,783 | B2 * | 8/2005 | Oliver | E02D 5/801 52/149 |
| 7,048,880 | B2 | 5/2006 | Kia et al. | |
| 2004/0194424 | A1 | 10/2004 | Frost et al. | |
| 2006/0254193 | A1 * | 11/2006 | Platts | E04G 23/0218 52/713 |

OTHER PUBLICATIONS

ACI Structural Journal, Technical Paper, Title No. 91-S34, May-Jun. 1994, "Fiber Composites for New and Existing Structure," by Hamid Saadatmanesh.

* cited by examiner

WALL REINFORCEMENT SYSTEM AND METHOD

CROSS-REFERENCE TO RELATED APPLICATIONS

This application claims the benefit of U.S. Provisional Application No. 60/973,299, filed on Sep. 18, 2007. The entire disclosure of the above application is incorporated herein by reference.

FIELD

The present disclosure relates to a system and method for reinforcing structural elements. In particular, the present disclosure relates to a system and method for wall reinforcement including an anchor system for coupling walls and support members.

BACKGROUND

The statements in this section merely provide background information related to the present disclosure and may not constitute prior art.

A variety of walls and other structural elements are known to be generally capable of supporting residential and light commercial structures. Over time, however, such walls and structural elements can crack, tilt, bow, or otherwise deform due to inherent weaknesses attributable to particular structural characteristics thereof.

For example, walls constructed of concrete blocks have excellent compressive strength to support structures placed upon them. However, these walls are inherently weak with respect to lateral loads and are particularly susceptible to cracking from water pressure, as the mortar joints at which these walls are connected are weak in tension and tend to separate relatively easily when subjected to tensile forces.

Deformation, such as cracking, tilting, and bowing, if left untreated, can become progressively greater and eventually facilitate collapse of an entire structural element with resultant damage to the structure supported thereon. While several methods are known for treating such deformation (e.g., it is known to adhere a carbon fiber material to a structural element, such as described in U.S. Pat. Nos. 6,746,741; 6,846,537; and 6,692,595), it would be desirable for a relatively simple and cost effective system and method for coupling a structural element to a separate support (e.g., a floor joist or other beam) in order to treat, prevent, or otherwise inhibit deformation of the structural element.

SUMMARY

The present disclosure provides a reinforcement system for a structural element. The reinforcement system includes a bracket secured to a support with a plurality of fasteners, a strap engaged with the bracket and disposed on the structural element, an adhesive material disposed on the structural element for securing the strap to the structural element, and a laminate for covering the assembly.

The present disclosure also includes a method for reinforcing a structural element. The method includes securing a bracket to a support proximate the structural element, engaging the bracket with a strap, securing the strap to the structural element with an adhesive, and covering the assembly with a laminate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4A:
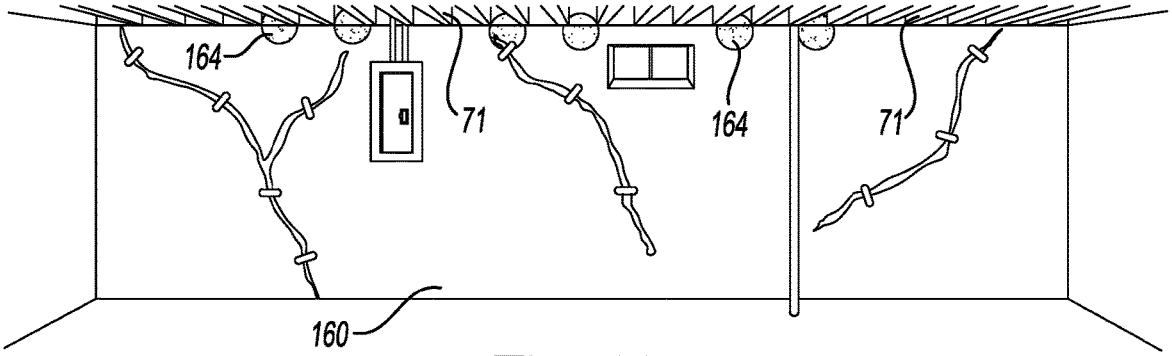
Figure 4B:
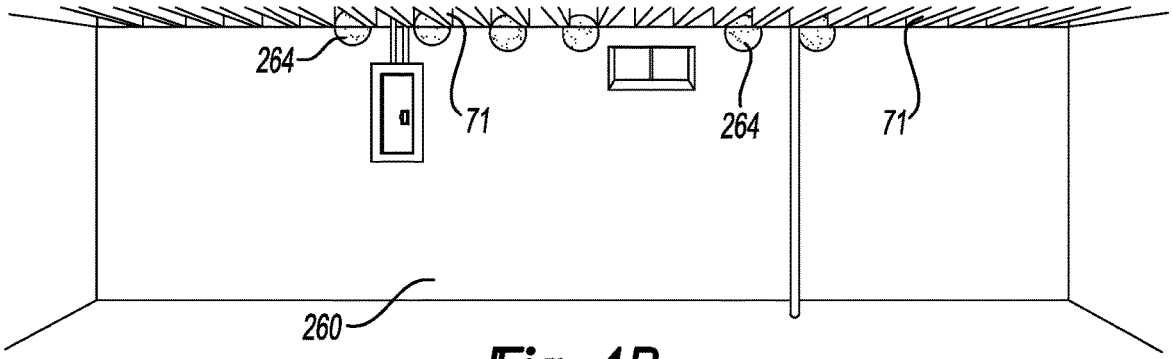
Figure 4C:
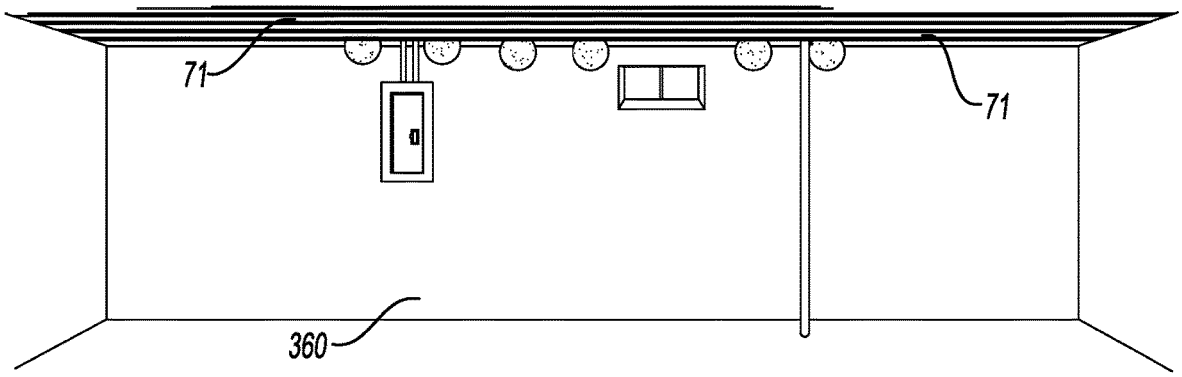

FIGS. 4A-C illustrate a variety of additional exemplary walls for use with a reinforcement system and method according to the principles of the present disclosure; and FIGS. 5A-H illustrate another set of exemplary steps for installing a reinforcement system and for a reinforcement method according to the principles of the present disclosure.

DETAILED DESCRIPTION

The following description is merely exemplary in nature and is not intended to limit the present disclosure, application, or uses.

Figure 1:
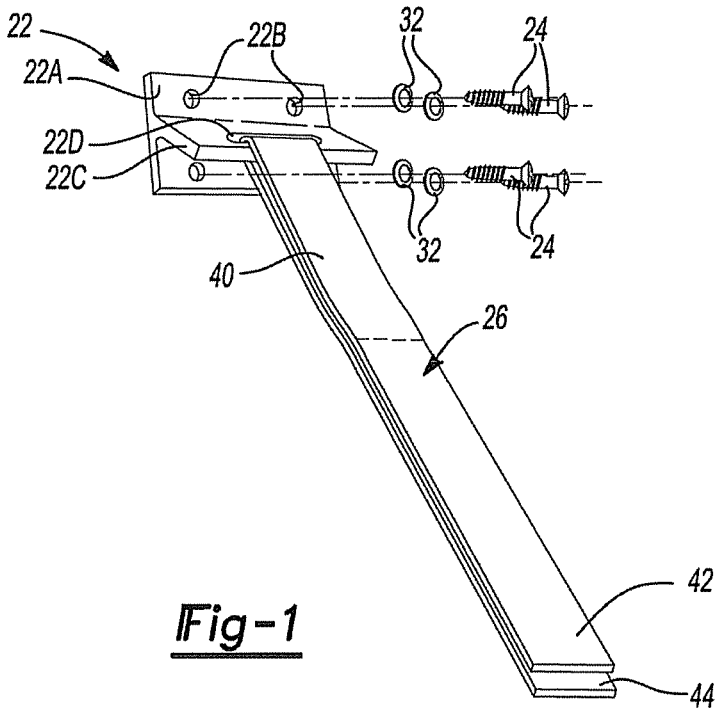
FIG. 1 is a perspective view of a reinforcement system according to the principles of the present disclosure.
Figure 3A:
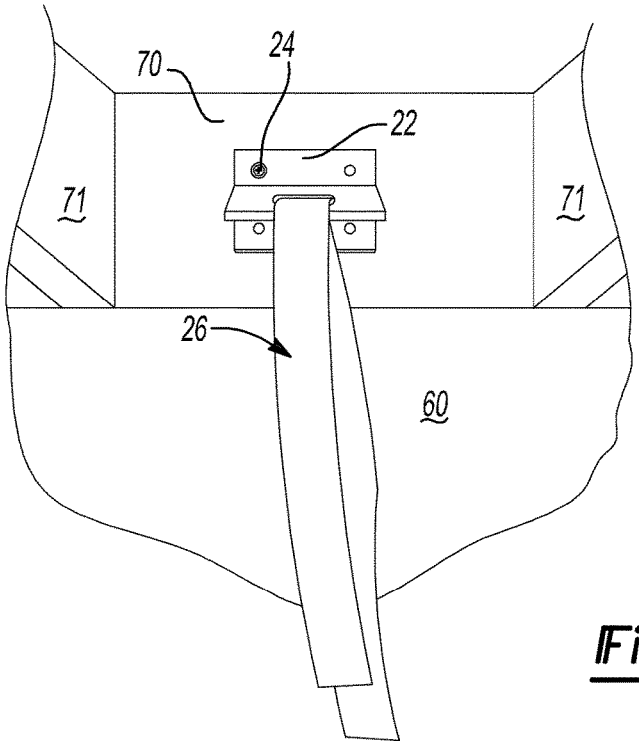
FIGS. 3A-3I illustrate exemplary steps for installing a reinforcement system and for a reinforcement method according to the principles of the present disclosure.
Figure 3B:
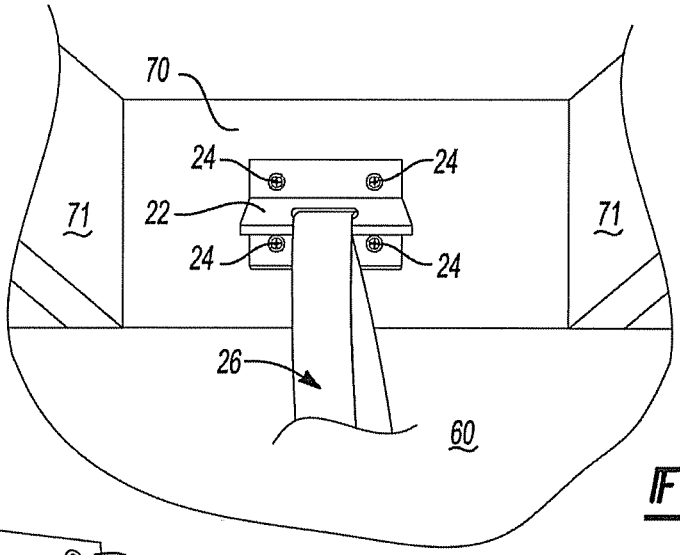
Figure 3C:
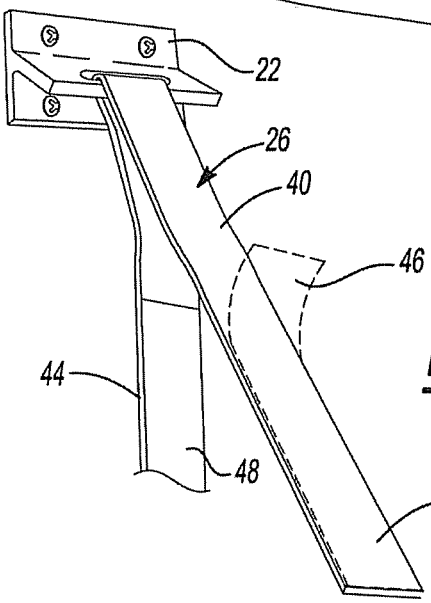
Figure 3D:
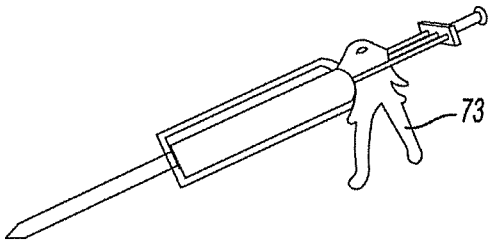
Figure 3E:
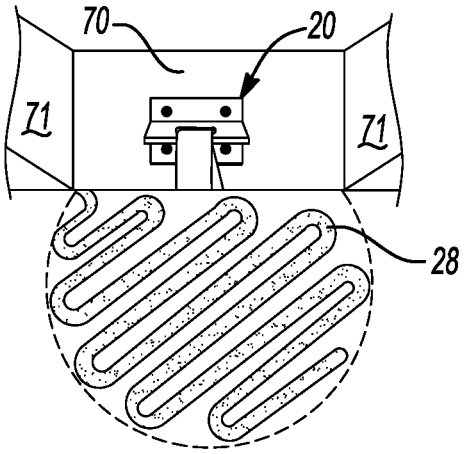
Figure 3F:
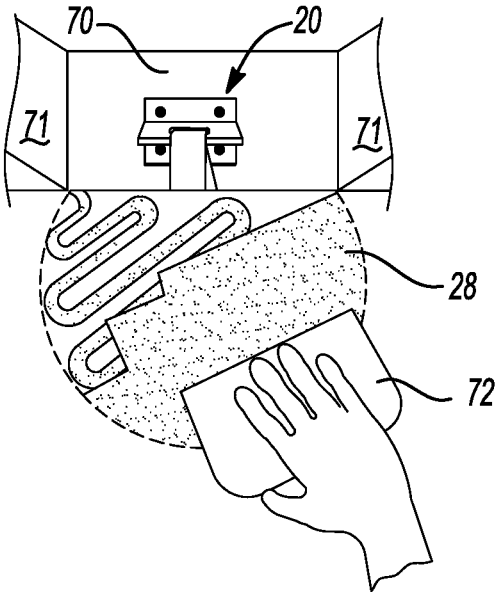
Figure 3G:
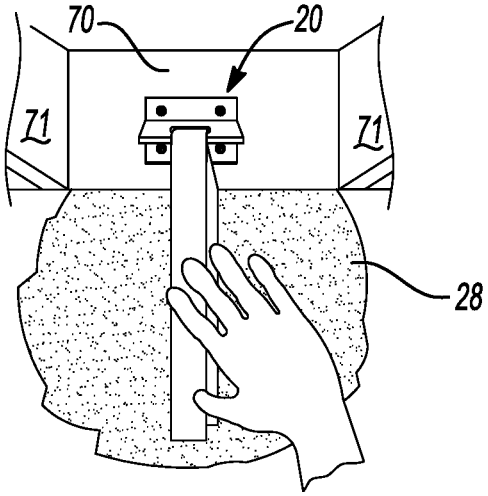
Figure 3H:
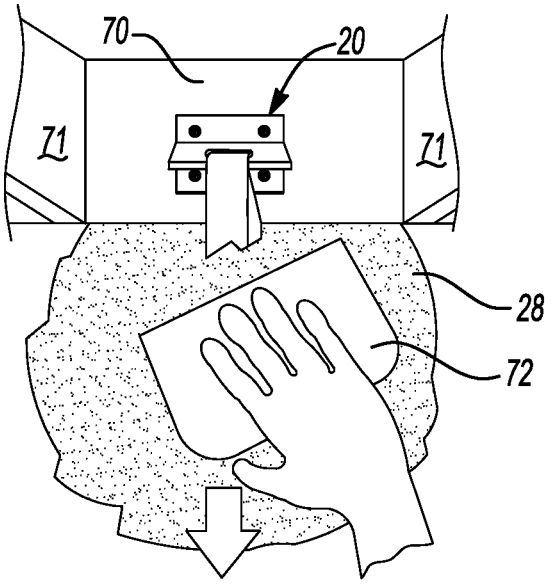
Figure 3I:
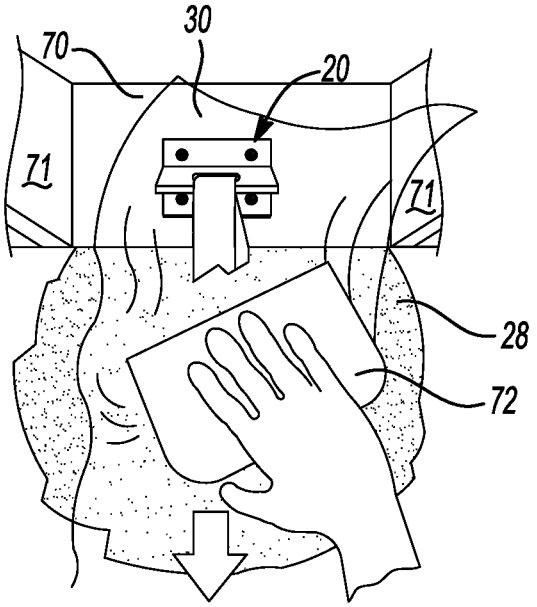

Referring to FIG. 1, a reinforcement system 20 according to the principles of the present disclosure is illustrated and described. Reinforcement system 20 includes a bracket 22, fasteners 24, and a strap 26. Reinforcement system 20 can also include an adhesive 28 (FIGS. 3D-3I) and a laminate 30 (FIG. 3I).

Bracket 22 is a relatively rigid component and can be made from a variety of materials. By way of non-limiting example, bracket 22 can be made of 6061 T-6 aluminum with a 3/16" structural T hard anodized coating. As best shown in FIG. 1, the bracket 22 can include a base portion 22A having a plurality of apertures 22B and a strap mounting portion 22C extending from the base portion 22A. The strap mounting portion 22C includes an elongated aperture 22D for receiving strap 26 therethrough. The strap mounting portion 22C can be angled relative to the base portion 22A with an angle up to 900, although an acute angle is preferred. Fasteners 24 are also relatively rigid components and can be made from a variety of materials. For example, 3/8"×2" zinc coated fasteners with standard threads may be used. Additionally, washers 32 may be used with fasteners 24.

Strap 26 is a flexible material with a relatively large tensile strength. For example, strap 26 can be made of an aramid composite fabric webbing which includes Kevlar® or other materials. Strap 26 can include a center portion 40 which is traditional fabric and ends 42, 44 which are pre-impregnated with adhesive and pre-cured in order to facilitate securing of strap 26 to a structural element as described in fuller detail herein. Prior to installation, ends 42, 44 can be covered/protected with peels 46, 48. Peels 46, 48 can have a textured surface that creates a roughened surface in the adhesive that is cured on ends 42, 44 of strap 26. The roughened surface helps to facilitate bonding with the adhesive.

Figure 2A:
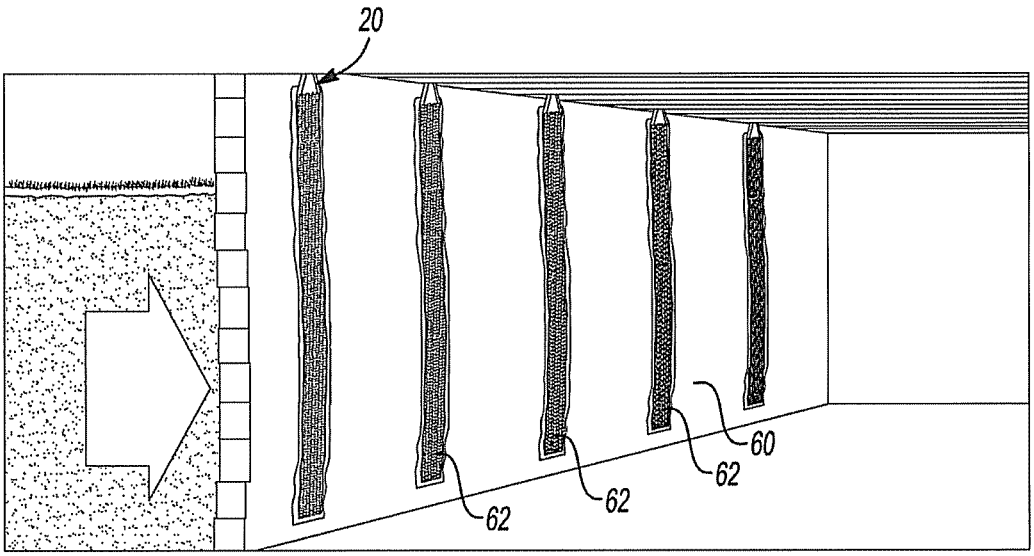
FIGS. 2A-2C illustrate an exemplary wall for use with a reinforcement system and method according to the principles of the present disclosure.
Figure 2B:
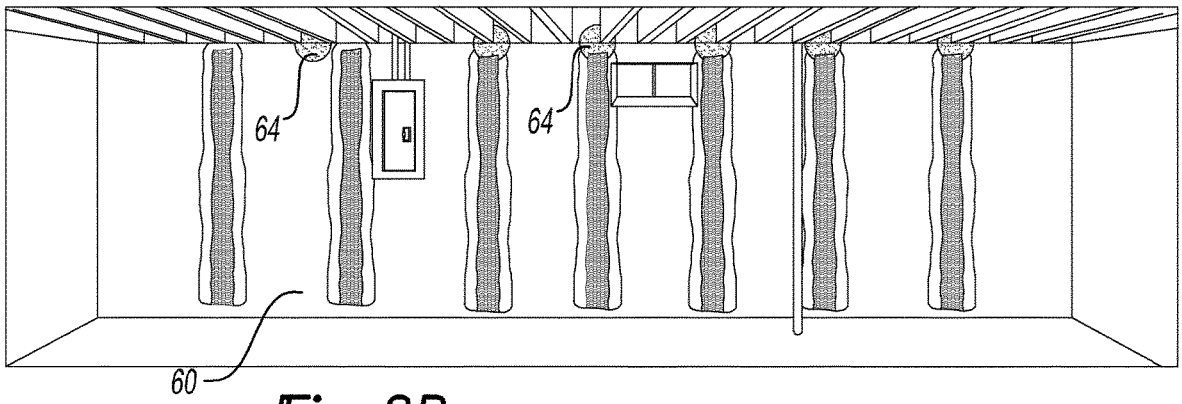
Figure 2C:
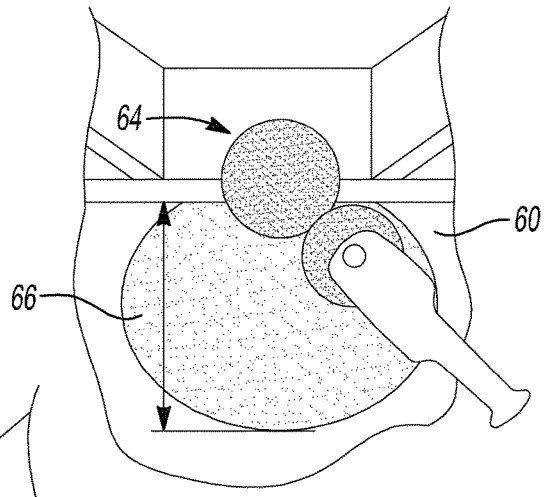

Referring to FIGS. 2A-2C, reinforcement system 20 can be utilized with a block wall 60. With particular reference to FIG. 2A, reinforcement system 20 is installed proximate the top portion of block wall 60. As illustrated, reinforcement system 20 may be installed in conjunction with carbon fiber wall strengthening assemblies 62 that can be assembled to the wall in the manner described in commonly assigned U.S. Pat. Nos. 6,746,741; 6,846,537 and 6,692,595. Furthermore, FIG. 2B illustrates exemplary installation locations 64 for reinforcement system 20 relative to block wall 60 and that such installation locations 64 can vary. Additionally, FIG. 2C is an exemplary illustration of the preparation of an installation location 64 before installation of reinforcement system 20. In particular, an area 66 of block wall 60 can be made free of paint and smoothed, such as by a grinder/sander, in order to enhance the adhesive characteristics of the area 66.

With particular reference to FIGS. 3A-31, exemplary steps for installing reinforcement system 20 and for a reinforcement method according to the present disclosure are illustrated. Referring to FIGS. 3A-3B, bracket 22 and strap 26 are engaged and bracket 22 is secured to a support member 70 by fasteners 24 proximate block wall 60. In a typical application, support member 70 can be an end plate (typically 2×10 or 2×12 lumber) which abuts against the ends of floor joists 71. The floor joists 71 reinforce the support member from moving so as to provide a firm foundation for the reinforcement system 20 to anchor to the wall 60. Referring to FIGS. 3C-3H, peels 46, 48 are removed from strap 26, adhesive 28 is applied to area 66 of block wall 60 from a tool (caulking gun) 73, and strap 26 is engaged with an adhesive 28. By way of example, a trowel 72 can be used to smooth out the adhesive 28 and engage strap ends 42, 44 with adhesive 28. Additionally, referring to FIG. 31, a laminate 30 (plastic sheet) can be applied over both strap 26 and bracket 22 to hold the straps 26 in place while the adhesive 28 cures.

According to the principles of the present disclosure, reinforcement system 20 can be used with a variety of types of walls. With particular reference to FIGS. 4A-4B, reinforcement system 20 can be used with a poured wall 160 and an intact wall 260. In particular, reinforcement system 20 can be utilized at installation locations 164, 264, respectively. Furthermore, referring to FIG. 4C, reinforcement system 20 can be used with a non-load-bearing wall 360, which is oriented so as to extend along floor joists 71.

Figure 5A:
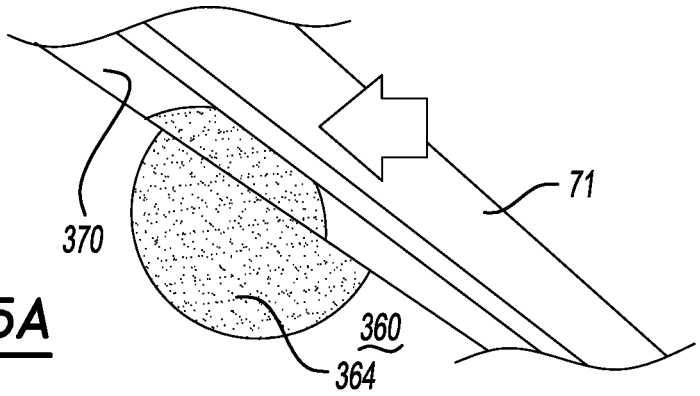
Figure 5B:
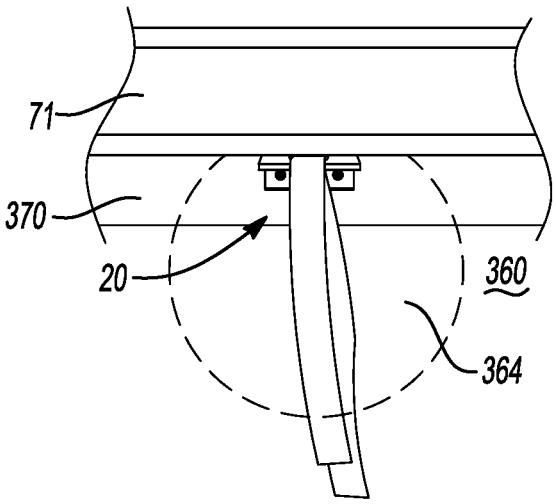
Figure 5C:
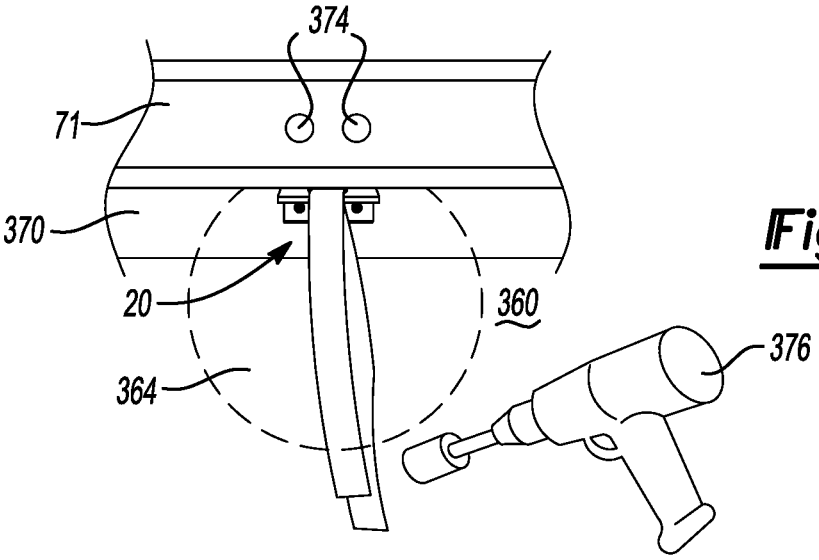
Figure 5D:
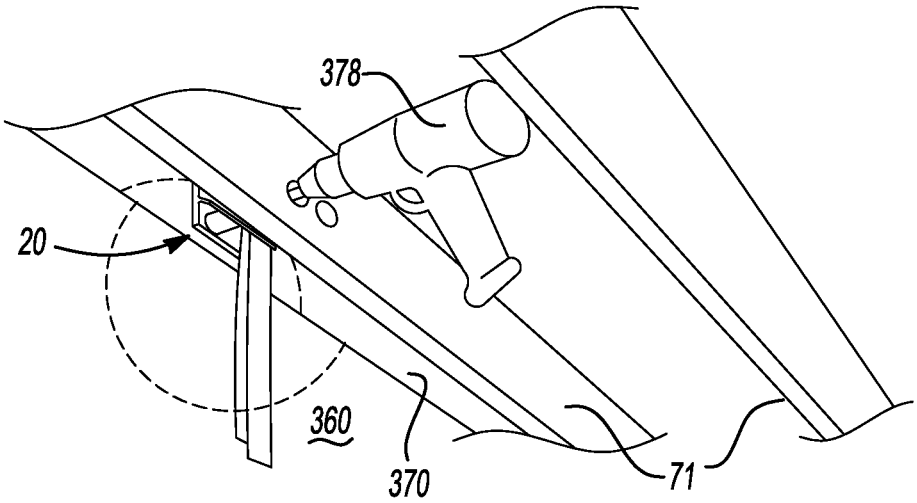
Figure 5E:
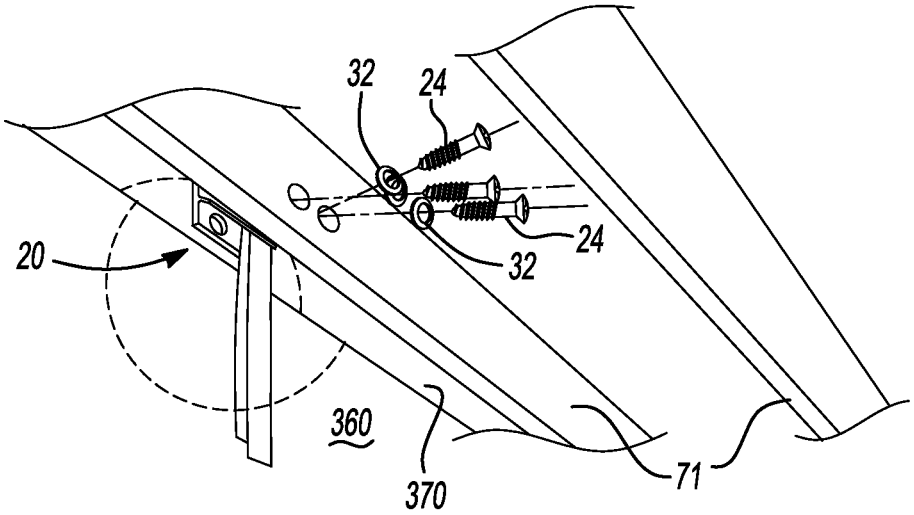
Figure 5F:
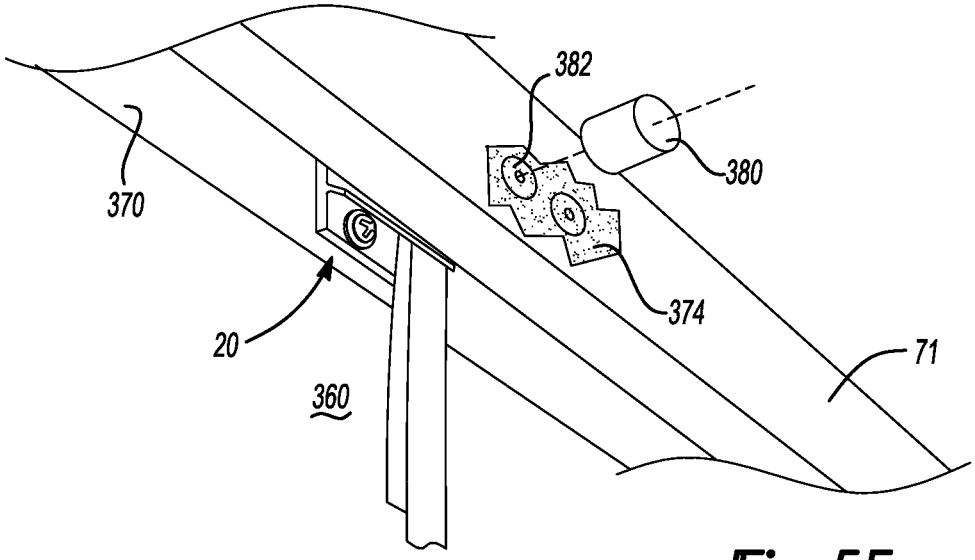
Figure 5G:
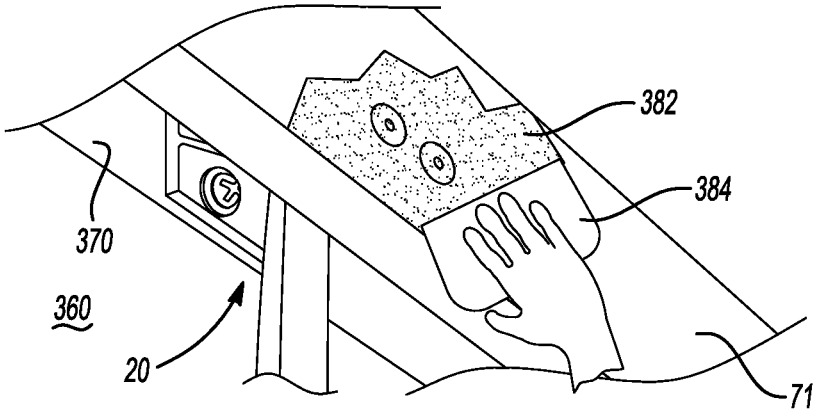
Figure 5H:
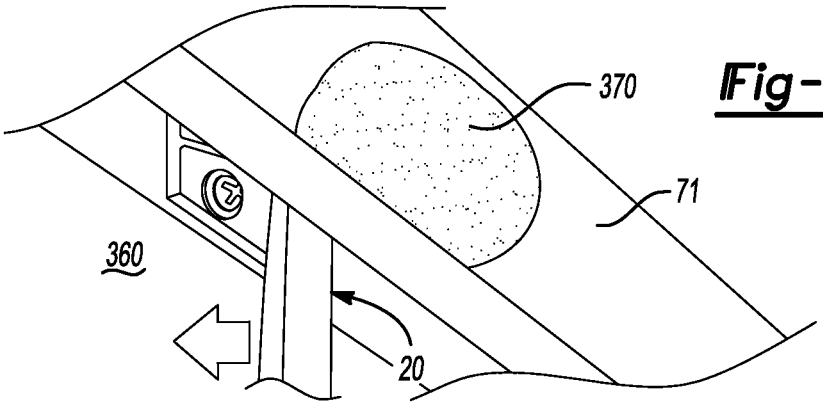

With particular reference to FIGS. 5A-5H, exemplary steps for installing reinforcement system 20 to non-load-bearing wall 360 are illustrated. Referring to FIGS. 5A-5B, selecting an installation location 364 proximate a top portion of non-load-bearing wall 360 and on a support member 370 and locating bracket 22 and strap 26 within installation location 364 are illustrated. Furthermore, referring to FIGS. 5C-5E, it may be necessary to form apertures 374 in an obstructing one of floor joists 71 adjacent to support member 370 with a tool 376 (e.g. a hole saw). The bracket 22 is secured to the support member 370 with another tool 378 (e.g. a torque wrench). Additionally, referring to FIGS. 5F-5H, apertures 374 can be filled in with plugs 380 and an epoxy 382 using a trowel 384. It should be understood that strap 26 can be secured to the non-load-bearing wall 360 similar as described herein with regard to block wall 60. The support member 370 can also be reinforced by known reinforcement methods.

The present disclosure can vary in many ways. For example, a reinforcement system according to the principles of the present disclosure can have a variety of components which each can have a variety of configurations and can be made of a variety of materials. Furthermore, the installation steps for a reinforcement system according to the principles of the present disclosure and reinforcement methods according to the principles of the present disclosure can vary. Additionally, a reinforcement system and method according to the principles of the present disclosure can be used in a variety of applications. As such, it should be understood that the present disclosure is exemplary in nature.

What is claimed is:

1. A structure, comprising:

a concrete block wall;

a support member formed from lumber and supported on top of said concrete block wall and disposed above said concrete block wall;

a bracket having a base portion secured directly to said support member by at least one fastener at a location above said concrete block wall and including a strap support portion connected to said base portion, wherein the bracket is disposed above said concrete block wall; and a flexible strap having a length dimension and a width dimension, said length dimension being greater than said width dimension, said flexible strap including first and second end portions along said length dimension and an intermediate portion disposed between said first and second end portions along said length dimension, said intermediate portion being wrapped directly around said strap support portion at a location above the concrete block wall, at least one of said first and second end portions being secured to an inside face of said concrete block wall by an adhesive.

2. The structure according to claim 1, wherein said bracket is made from metal.

3. The structure according to claim 1, wherein said strap is a fabric webbing.

4. The structure according to claim 1, wherein said strap support portion extends at an acute angle from said base portion and includes an elongated aperture receiving said intermediate portion of said strap therein.

5. The structure according to claim 1, wherein said strap includes pre-cured adhesive with a peel applied thereto.

6. The structure according to claim 1, wherein both of said first and second end portions extend away from said bracket in substantially the same direction.

7. The structure according to claim 1, wherein said support member is an end plate made from lumber and abutting an end of a plurality of floor joists.

8. The structure according to claim 1, further comprising a fiber reinforcement strip adhered to the concrete block wall.

9. A structure, comprising:

a concrete block wall;

a support member made from lumber and supported on top of said concrete block wall and disposed above said concrete block wall;

a bracket having a base portion secured directly to said support member by at least one fastener at a location above said concrete block wall and a strap support portion connected to said base portion, wherein the bracket is disposed above the concrete block wall; and an elongated flexible fabric strap having a first portion secured to said strap support portion of said bracket at a location above the concrete block wall and having a second portion being directly secured to an inside face of said concrete block wall by an adhesive.

10. The structure according to claim 9, further comprising a fiber reinforcement strip adhered to the concrete block wall.

11. The structure according to claim 9, wherein said bracket includes said strap mounting portion extending at an angle from said base portion and including an elongated aperture for receiving said fabric strap therein.

12. A method of reinforcing a concrete block wall structure, comprising:

securing a bracket directly to a support member that is supported on top of said concrete block wall structure at a location above said concrete block wall structure wherein the bracket is above the concrete block wall structure;

attaching a flexible fabric strap around at least a portion of said bracket at a location above the concrete block wall structure; and adhering said flexible fabric strap directly to an inside face of said concrete block wall structure.

13. The method according to claim 12, wherein said bracket is made from metal.

14. The method according to claim 12, wherein said fabric strap is a fabric webbing.

15. The method according to claim 12, wherein said bracket includes a base portion and a strap mounting portion extending at an acute angle from said base portion and including an elongated aperture for receiving said fabric strap therein.

16. The method according to claim 12, wherein said fabric strap includes pre-cured adhesive with a peel applied thereto.

17. The method according to claim 12, wherein said support member is an end plate made from lumber and abutting an end of a plurality of floor joists.

18. The method according to claim 12, further comprising a fiber reinforcement strip adhered to the concrete block wall.

* * * * *